US007854687B2

(12) United States Patent
Alexander

(10) Patent No.: US 7,854,687 B2
(45) Date of Patent: Dec. 21, 2010

(54) TRAMPOLINE AND ENCLOSURE SYSTEM

(75) Inventor: Keith Vivian Alexander, Christchurch (NZ)

(73) Assignee: Board & Batten Inc., Georgetown (KY)

( * ) Notice: Subject to any disclaimer, the term of this patent is extended or adjusted under 35 U.S.C. 154(b) by 605 days.

(21) Appl. No.: 10/582,551

(22) PCT Filed: Dec. 9, 2004

(86) PCT No.: PCT/NZ2004/000318

§ 371 (c)(1),
(2), (4) Date: Jun. 20, 2007

(87) PCT Pub. No.: WO2005/058428

PCT Pub. Date: Jun. 30, 2005

(65) Prior Publication Data

US 2008/0269020 A1 Oct. 30, 2008

(30) Foreign Application Priority Data

Dec. 19, 2003 (NZ) ..... 530271

(51) Int. Cl.
*A63B 21/00* (2006.01)

(52) U.S. Cl. ..... 482/27; 482/28

(58) Field of Classification Search ..... 482/27, 482/28, 142, 130
See application file for complete search history.

(56) References Cited

U.S. PATENT DOCUMENTS 5,399,132 A 3/1995 Bailey
5,941,798 A 8/1999 Coan et al.
6,053,845 A * 4/2000 Publicover et al. ..... 482/35
6,135,922 A 10/2000 Nissen
6,261,207 B1 7/2001 Publicover et al.
6,319,174 B1 * 11/2001 Alexander ..... 482/27
6,336,893 B1 1/2002 Chen
6,634,978 B2 10/2003 Banno et al.
2003/0064861 A1 4/2003 Chen
2005/0079954 A1 4/2005 Wang et al.
2006/0270525 A1 * 11/2006 Colling ..... 482/27

FOREIGN PATENT DOCUMENTS

WO 03/043704 5/2003

* cited by examiner

*Primary Examiner*—Jerome Donnelly
(74) *Attorney, Agent, or Firm*—Dann, Dorfman, Herrell and Skillman, P.C.

(57) ABSTRACT

A trampoline comprising a flexible mat (3) and a plurality of springs (4) holding the mat in tension within a peripheral frame (1) of the trampoline which surrounds the mat has an enclosure system surrounding the mat. The enclosure has a lower peripheral part coupled to the mat and a plurality of resiliently flexible upright enclosure members (5) to support the barrier above the mat. The enclosure support members are free to resiliently deform away from the mat when impacted by a user against the barrier. They are also connected together at the upper ends of the enclosure support members away from their natural rest state and towards the center of the mat. When impacted by a user against the barrier on the side of the enclosure causing the barrier to resiliently deform away from the mat, the enclosure support members are resiliently deformed towards the center of the mat.

8 Claims, 5 Drawing Sheets

TRAMPOLINE AND ENCLOSURE SYSTEM

FIELD OF THE INVENTION

The present invention relates to an improved trampoline and enclosure system.

BACKGROUND TO THE INVENTION

U.S. Pat. No. 6,053,845 describes an enclosure for a trampoline consisting of a net fence or barrier which surrounds the trampoline and is supported by upright poles spaced around the periphery of the trampoline and fixed to the trampoline frame.

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

SUMMARY OF THE INVENTION

It is an object of the invention to provide an improved or at least alternative trampoline enclosure, for a spring-based trampoline.

In one aspect the invention may be said to comprise a trampoline and enclosure system comprising:

a trampoline comprising a flexible mat and a plurality of springs holding the mat in tension within a peripheral frame of the trampoline which surrounds the mat; and an enclosure system comprising a barrier of a flexible material surrounding the mat above the mat and having a lower peripheral part coupled directly or indirectly to the mat and a plurality of resiliently flexible generally upright enclosure support members outside of the barrier relative to the mat and which are connected at or towards the lower ends of the enclosure support members to the frame of the trampoline and at or towards their upper ends to the barrier at or near an upper peripheral part of the barrier to support the barrier above the mat, and which are free to resiliently deform away from the mat when impacted by a user against the barrier or an enclosure support member, and which are also connected together at or towards the upper ends of the enclosure support members to draw and pretension the upper ends of the enclosure support members away from their natural rest state (when connected only at their lower ends to the frame of the trampoline) and towards the center of the mat.

Typically the barrier comprises a flexible net material and the enclosure support members are resiliently flexible pultruded fibreglass rods.

In broad terms in another aspect the invention may be said to comprise a trampoline and enclosure system including:

a trampoline comprising a flexible mat and a plurality of coil springs holding the mat in tension within a peripheral frame of the trampoline which surrounds the mat; and an enclosure system comprising a barrier of a flexible net material surrounding the mat above the mat and having a lower peripheral part coupled directly or indirectly to a periphery of the mat and a plurality of resiliently flexible generally upright enclosure support members outside of the barrier relative to the mat and which are connected at or towards the lower ends of the enclosure support members to the frame of the trampoline so that in their natural rest state (when connected only at the lower ends to the frame of the trampoline) the enclosure support members extend away from the mat, and which are connected to the barrier net only at or near an upper peripheral part of the barrier to hold the net in tension above the mat, and which enclosure support members are also connected together at or towards the upper ends of the enclosure support members to draw the upper ends of the enclosure support members away from their natural rest state (when connected only at their lower ends to the frame of the trampoline) and towards the center of the mat, so that when impacted by a user against the barrier on one side of the enclosure causing the barrier and enclosure support member on that side of the enclosure to resiliently deform away from the mat, the enclosure support members and barrier on the opposite side of the enclosure will be resiliently deformed towards the center of the mat.

1. In broad terms in a further aspect the invention comprises a trampoline and enclosure system comprising:

a trampoline comprising a flexible mat and a plurality of coil springs holding the mat in tension within a peripheral frame of the trampoline which surrounds the mat; and an enclosure system comprising a barrier of a flexible net material surrounding the mat above the mat and having a lower peripheral part coupled directly or indirectly to a periphery of the mat and a plurality of resiliently flexible generally upright enclosure support members outside of the barrier relative to the mat and which are connected at or towards the lower ends of the enclosure support members to the frame of the trampoline and which are connected to the barrier net only at or near an upper peripheral part of the barrier to hold the net in tension above the mat, and which enclosure support members are also connected together at or towards the upper ends of the enclosure support members to draw the upper ends of the enclosure support members away from their natural rest state (when connected only at their lower ends to the frame of the trampoline) and towards the center of the mat, so that when impacted by a user against the barrier on one side of the enclosure causing the barrier and enclosure support member on that side of the enclosure to resiliently deform away from the mat, the enclosure support members and barrier on the opposite side of the enclosure will be resiliently deformed towards the center of the mat.

In this specification (including claims) the term "trampoline" is intended to extend to smaller trampolines commonly referred to as rebounders also, as well as larger trampolines of all sizes. Trampolines of the invention may be circular, square, rectangular, or of other shapes such as octagonally shaped in plan view for example.

The term 'comprising' as used in this specification and claims means 'consisting at least in part of', that is to say when interpreting independent claims including that term, the features prefaced by that term in each claim all need to be present but other features can also be present

BRIEF DESCRIPTION OF THE DRAWINGS

Preferred embodiments of the invention will be described with reference to the accompanying drawings, of which.

DETAILED DESCRIPTION OF THE PREFERRED EMBODIMENTS

Figure 1:
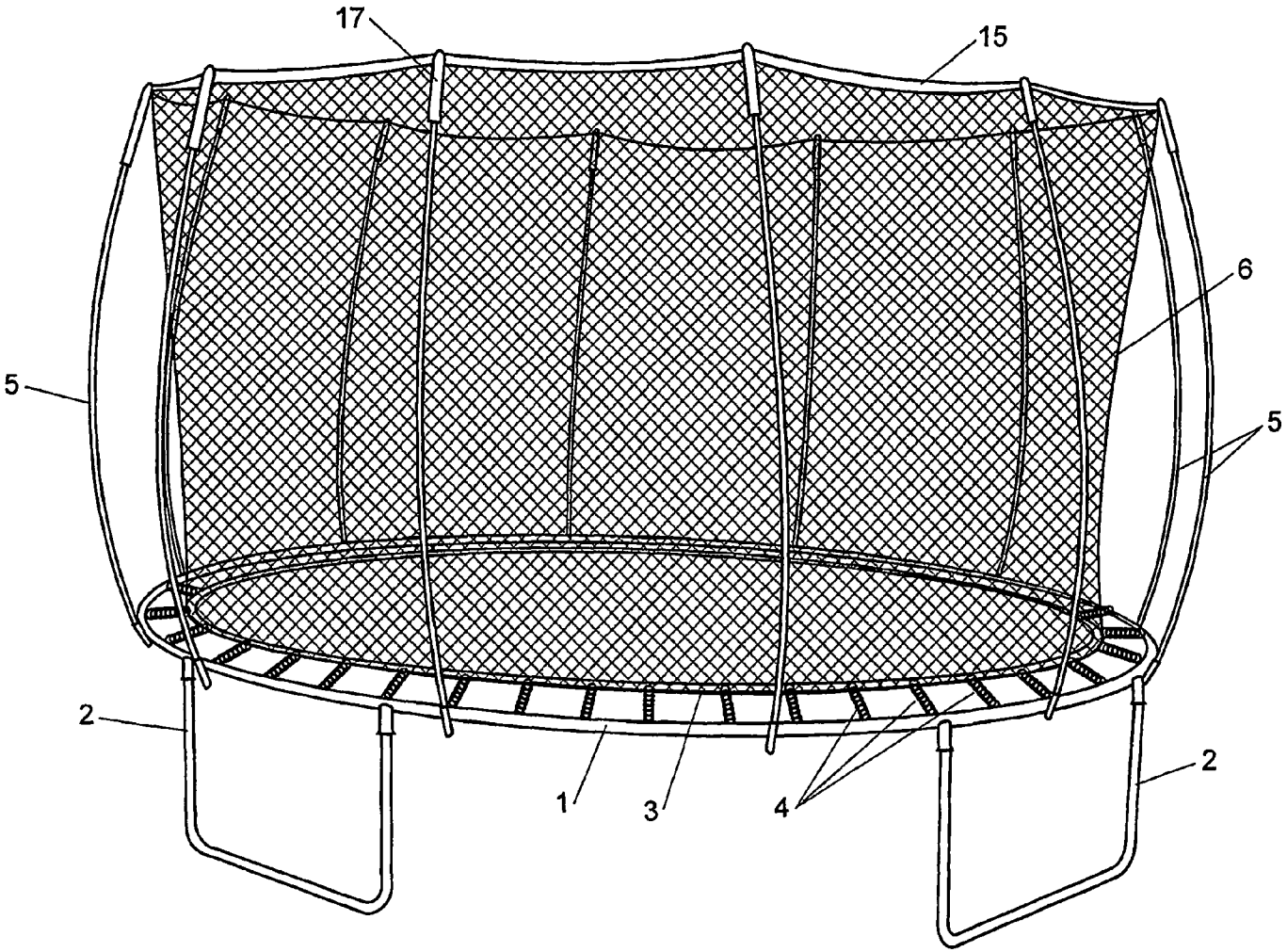
FIG. 1 is a side view of a trampoline and enclosure system of the invention.
Figure 2:
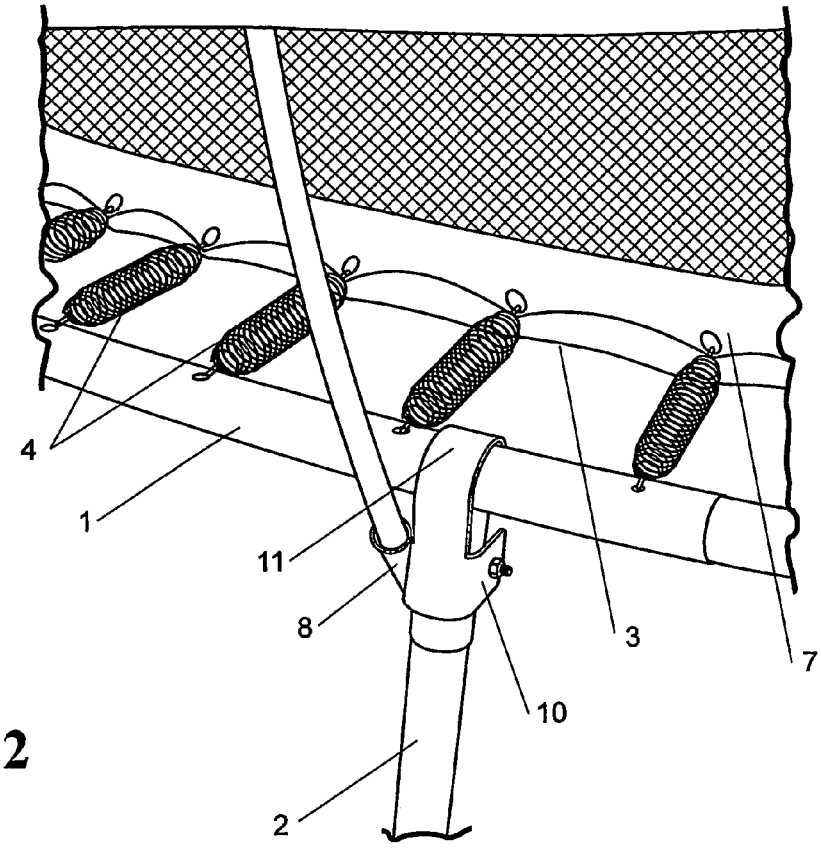
FIG. 2 is a view of part of the trampoline frame and of a tubular socket fitting attached thereto mounting the lower end of an enclosure support member.
Figure 3:
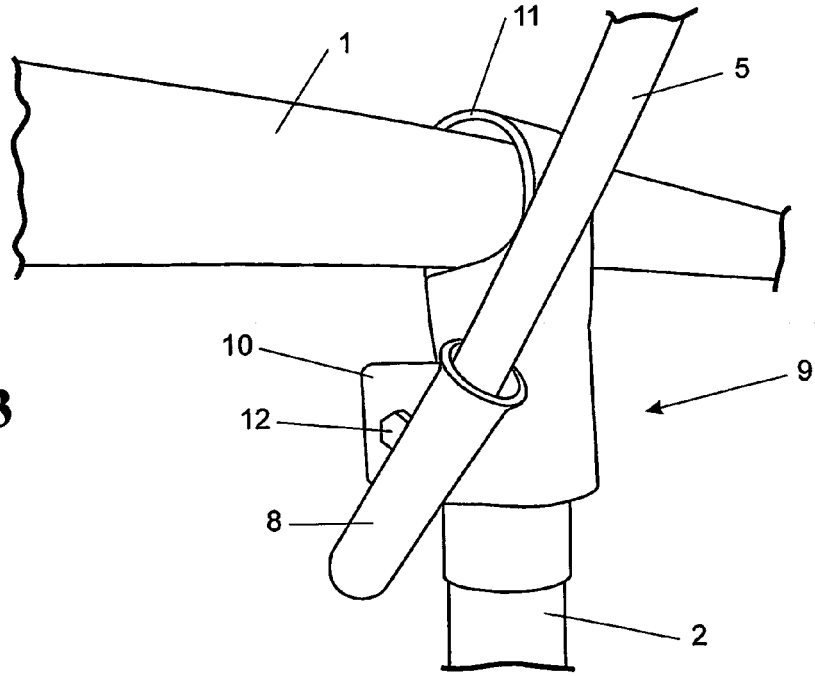
FIG. 3 is a closer view of the tubular socket fitting shown in FIG. 2.

Referring to FIGS. 1 to 3 the trampoline shown comprises a peripheral frame 1 supported by legs 2. The frame in the form shown is circular and is typically formed of steel or aluminium for example. A flexible mat 3 on which users may bounce is held in tension within the frame 1 by springs 4 which are connected between the edge of the mat and the peripheral frame to hold the mat in tension. Typically the springs are coil springs the wire ends of which are formed into hooks so that one end of each spring hook-engages the edge of the trampoline mat while the other end of each spring hooks into a hole in the circular trampoline frame. The trampoline shown is circular in shape but the trampoline could be of any other desired shape such as oval, square, rectangular or similar.

The trampoline also comprises an enclosure system as shown. The enclosure system consists of a plurality of resiliently deformable generally upright enclosure support members 5 which in the preferred form are deformable or flexible fibreglass rods and may in particular be pultruded fibreglass rods, but may alternatively be spring steel elements for example. Hereinafter the enclosure support members 5 will be referred to as enclosure rods for convenience, but it is to be understood that this term is non-limiting in relation to the size and cross-sectional shape of the enclosure support elements and the material from which they are formed, provided that they provide the required degree of flexibility in accordance with the invention.

The enclosure system also comprises a barrier net 6. The enclosure rods 5 support the net 6 above the mat 3, and the lower edge of the barrier net 6 is coupled directly or indirectly to the peripheral edge of the mat.

The enclosure rods 5 are positioned on the outside of the barrier 6 as shown. The enclosure rods 5 are coupled to the trampoline frame at the lower ends of the enclosure rods, and to the upper peripheral part of the net 6 at or towards the upper ends of the enclosure rods.

The barrier 6 is preferably formed of a lightweight but strong net material but may alternatively be a flexible fabric material which is for example opaque or which is perforated so as to be semi-opaque. In the preferred form, as shown in FIG. 2 a band 7 of a stronger material such as a webbing material for example, is fixed to the lower peripheral edge of the barrier net, and comprises holes through which the hooks on the ends of the springs 4 pass before the hooks also hook into holes about the edge of the mat 3 as referred to previously, so that the lower edge of the barrier net 6 and the edge of the mat 3 are held together. Alternative arrangements are possible for example the lower edge of the barrier net may be stitched or otherwise affixed directly to the periphery of the mat. The net is held in tension between the top of the enclosure rods and the edge of the trampoline mat.

FIGS. 2 and 3 show how the lower ends of the enclosure rods 5 may be connected to the trampoline frame. A tubular socket 8 is carried by a bracket 9 a which includes a U-shaped clamp part 10 which encircles an upright leg part of the trampoline frame and clamps the socket 8 to the frame. The U-shaped bracket may be closed by a bolt and nut 12 for example. A hook part 11 of the bracket extends upwardly and over the trampoline frame 1 as shown to assist in locating the bracket 9 vertically. Any other mechanical equivalent arrangement for holding the lower ends of the closure rods at an angle may be utilised. Also it is not necessary that a bracket 9 or equivalent is provided only at each trampoline leg 2. Alternatively a bracket could clamp to the frame 1 between legs 2 or tubular holders 8 or equivalent could be fixed by welding for example to the lower external part of the frame member 1.

The sockets 8 or equivalent are oriented so that the enclosure rods are preferably retained by the trampoline frame at their lower ends so that in the natural rest state of the enclosure rods, when connected only at their lower ends to the frame of the trampoline and before fitting of the barrier net, the enclosure rods will extend at an angle away from the mat of the trampoline as shown. Thus, when the net is fitted to connect the upper ends of the enclosure rods, or some other flexible connecting element which connects the upper ends of the enclosure rods is fitted, this will draw the upper ends of the enclosure rods away from their natural state of rest and towards the center of the mat, to the position generally as shown in FIG. 1, to pre-tension the enclosure rods. The enclosure support rods act like fishing rods, and are set to hold up and tension the enclosure net adequately for the play or safety function. The higher is such pre-tension in the support rods the stronger rebound capability the enclosure net has. In addition it may not be essential that the enclosure rods are mounted so that they extend in a vertical plane. Alternatively the enclosure rods may extend to one side or the other, in a plane at an angle to the vertical and/or horizontal.

Figure 4:
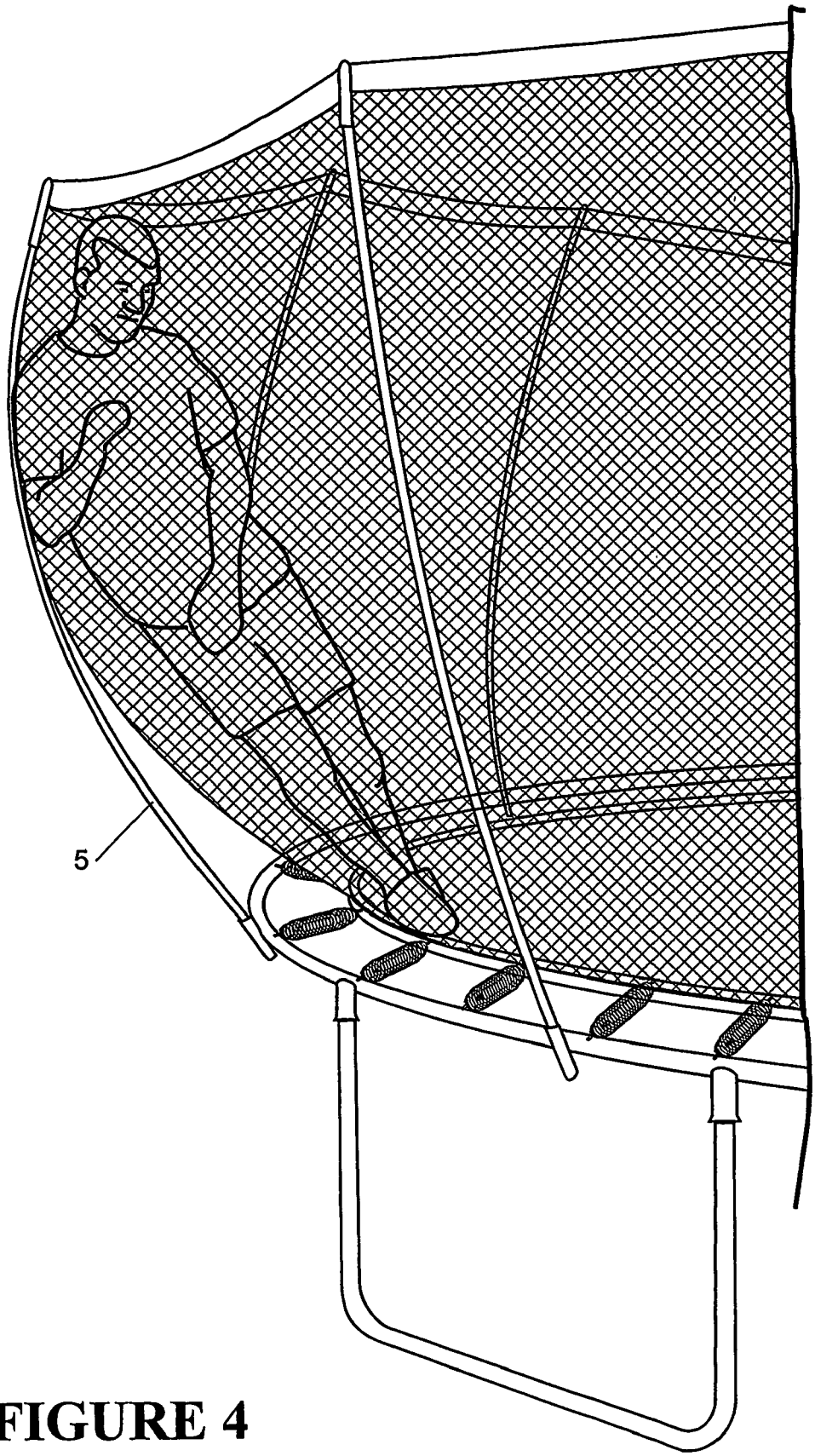
FIG. 4 illustrates the trampoline and enclosure system in use.

In a most simple form the upper ends of all of the enclosure rods 5 may be connected by a line. In the preferred form shown a band 15 such as a webbing strap fixed for example by sewing to the upper peripheral edge of the barrier net 6 couples the upper ends of all of the enclosure rods 5. The rods are coupled so that they are bowed or drawn away from their natural state of rest (when connected only at their lower ends to the frame of the trampoline) and towards the center of the mat. In an alternative form a line or band may couple the enclosure rods at or towards their upper ends, which is a separate component from the net itself. Such a separate band or line may incorporate a buckle or adjustable connector which allows for adjustment of the length of the band or line to enable the degree of pre-tension applied to the enclosure rods 5 to be varied, thus varying the strength of rebound that will be provided. Because the enclosure rods are coupled to the trampoline and mat only at or towards their lower ends they are free to move relative to the mat as shown in FIG. 4. The enclosure rods are highly flexible or deformable. The degree of resilience may be such that an average size or weight user (for example a 80 kg user) deforming the enclosure to the extent shown in FIG. 4 or to a greater extent will be rebounded back onto the mat.

Typically the trampoline will be delivered to a purchaser in disassembled form. The enclosure may be supplied together with the trampoline or separately, and may be factory fitted, or retrospectively self-fitted by a user. It may come in component form as a kit, or preassembled for attachment to the trampoline. This provides an enclosure that is specifically designed to function as a play and safety addition to a trampoline.

The resulting enclosure system has a high degree of flexibility or deformability. This is illustrated in FIG. 4, which shows a user impacting against the barrier net 6 and one enclosure rod 5, and it can be seen that the enclosure rod freely deforms away from the trampoline. At the same time the lower edge of the net remains coupled to the trampoline mat. Typically when an average sized or weight user hits the enclosure so that the enclosure deforms to this extent or more, the impact energy absorbed by the enclosure will gently rebound the user back onto the trampoline mat. The upper ends of all of the enclosure rods are connected together so that all of the enclosure rods and net form a dynamic rebound surface. That is, a user impacting any side of the enclosure will cause all of the rods to deform to some extent. The enclosure is such that when the enclosure is impacted by a user on one side causing the barrier on that side of the enclosure to deform away from the mat as shown in FIG. 4 for example or more, the enclosure support members and barrier on the opposite side of the enclosure will be deformed inwardly towards the center of the mat. Also, the enclosure rods 5 are outside and thus removed from the direct area of play, are deformable and mounted by their lower ends only so as to not cause injury when they are hit from the side and unlikely to cause injury if landed on from above, but provide enough tension to the net to give the required rebounding response to a jumper hitting it.

Figure 5:
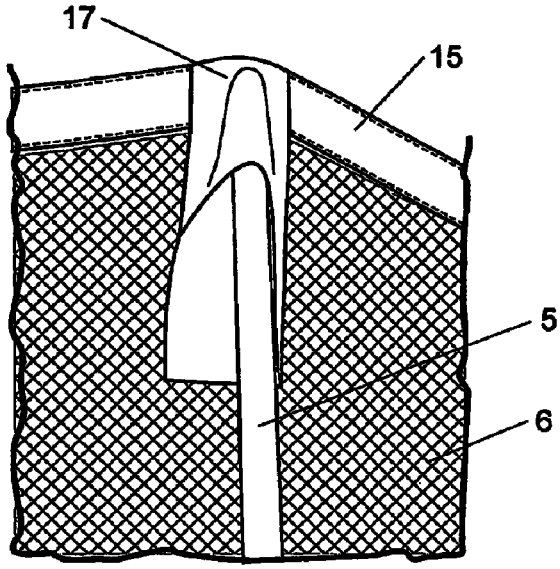
FIGS. 5 and 6 show a portion of the upper peripheral edge of the barrier net of the preferred form trampoline and the upper end of an enclosure support rod which engages into a pocket fixed to the upper edge of the barrier net.
Figure 6:
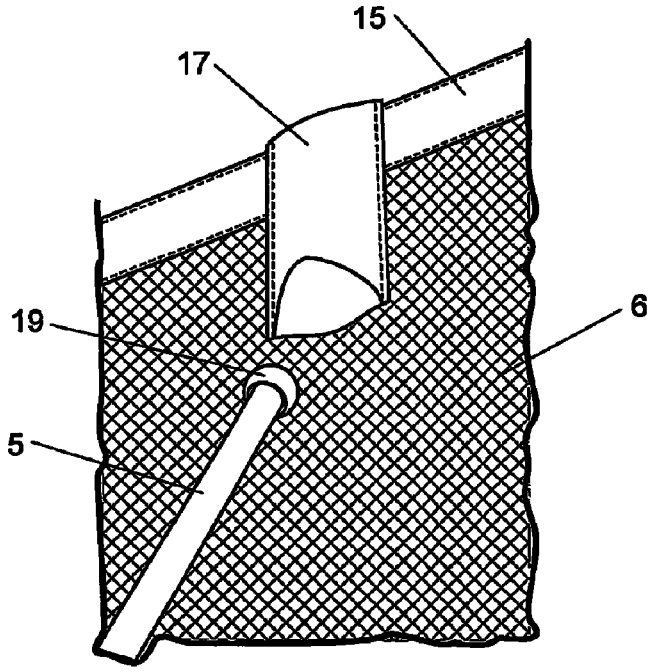
Figure 7:
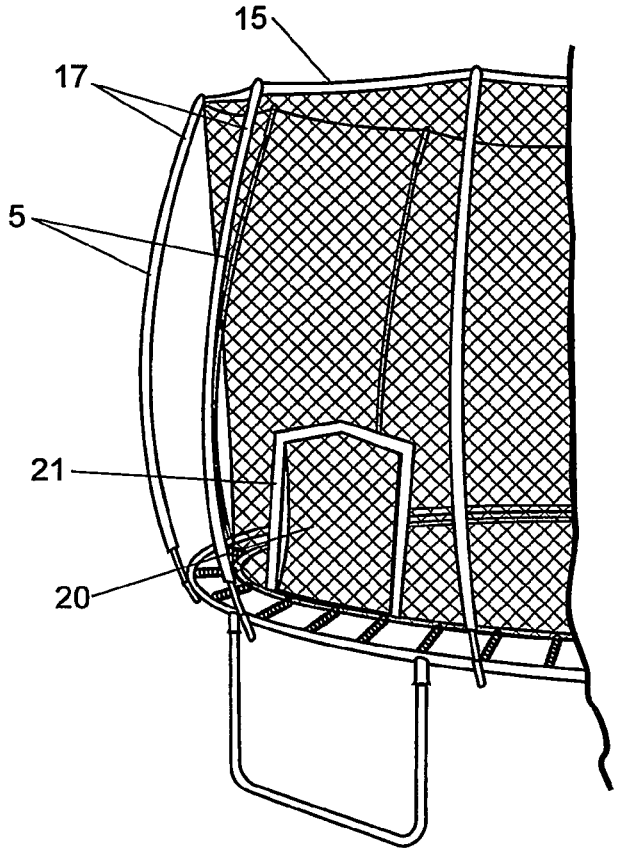
FIG. 7 shows one side of a preferred form trampoline and long pockets fixed to the upper edge of the barrier net and into which the enclosure support rods engage to mount the barrier net to the support rods.

Referring to FIGS. 5 and 6, the enclosure net may be supported at its upper periphery by pockets 17 provided at or near an upper periphery of the enclosure net, which will fit over the upper ends of the enclosure rods 15 as shown. The pockets 17 may be stitched or otherwise fixed to the enclosure net and/or band 15 around the top of the enclosure. As shown in FIG. 7 the pocket 17 may be coupled to the barrier net 6 only at or adjacent the upper peripheral edge of the net. Optionally the pockets 17 may be lined with or formed of a compressible material such as synthetic foam or foam rubber material to further reduce the risk of any injury on impact with the enclosure rod by a jumper. Longer pockets the full length of the rods and preferably attaching at the bottom to the sockets 8 (as shown in FIG. 7) reduce any risk of the pockets separating from the enclosure rods during active bouncing on the trampoline and against the barrier net. The risk of a bystander such as a child pulling an enclosure rod from the pocket is also reduced.

Figure 8:
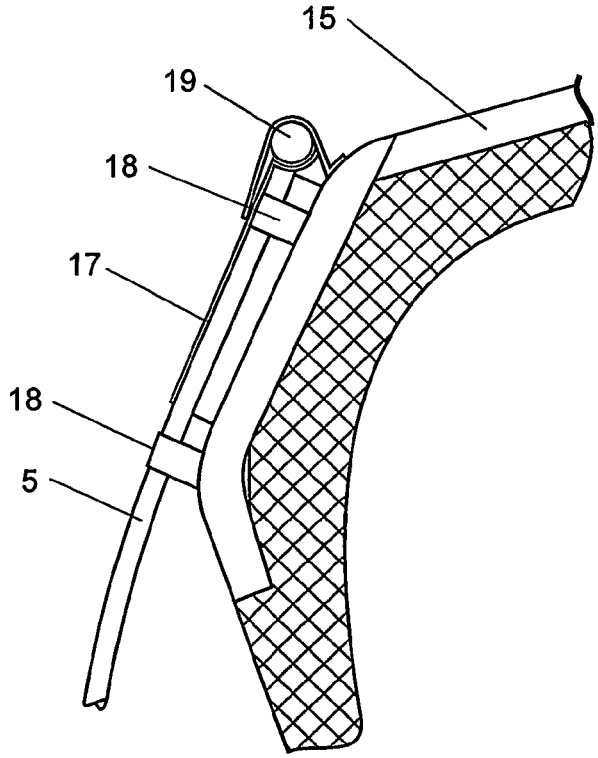
FIG. 8 schematically shows a further pocket system for mounting the upper peripheral edge of the barrier net to the upper ends of the enclosure support rods.

FIG. 8 shows an alternative arrangement in which again a pocket 17 is provided at the upper periphery of the enclosure net for each enclosure rod 5. In this embodiment the pocket 17 is a shorter length pocket as shown. Safety loops 18 typically formed of a webbing material are provided through which the upper end of the enclosure rod 5 passes, which take the approximately lateral load between the upper end of the enclosure rod and the barrier net, one safety loop 18 within the pocket and the other below the pocket as shown. Thus the contact point between the top of the pocket 17 and the upper end of the rod enclosure 5 carries only approximately vertical force. Preferably the upper end of the enclosure rod 5 in this and other embodiments is enlarged as shown for example by fitting of a ball shaped end 19 to the rod end. The webbing loops 18 act to prevent the rod 5 with its attached ball 19 from being pulled downwards when the net 6 is tight, so preventing the rods 5 from being pulled inadvertently from the pocket 17 once the net 6 is assembled.

Preferably as also shown in FIG. 7, the barrier net incorporates an integral door 20 as a flap sewn into the net. A hook and loop fastening material such as VELCRO is used between the edges of the door and the aperture through the barrier net as at 21. Alternatively, zippers may be used, or a combination of a hook and loop material and one or more zippers. The door aperture flap may be in any suitable form such as a square door flap and aperture as shown, or alternatively an inverted T-form with flaps on either side and a center fastener or similar.

The foregoing describes the invention including preferred forms thereof. Alterations and modifications as will be obvious to those skilled in the art are intended to be incorporated and within the scope thereof as defined in the accompanying claims.

I claim:

1. A trampoline and enclosure system comprising:

a trampoline comprising a flexible mat and a plurality of coil springs holding the mat in tension within a peripheral frame of the trampoline which surrounds the mat; and an enclosure system comprising a barrier of a flexible net material surrounding the mat above the mat and having a lower peripheral part coupled directly or indirectly to a periphery of the mat and a plurality of resiliently flexible generally upright enclosure support members outside of the barrier relative to the mat and which are connected at or towards the lower ends of the enclosure support members to the frame of the trampoline and which are connected to the barrier net only at or near an upper peripheral part of the barrier to hold the net in tension above the mat, and which enclosure support members are also connected together at or towards the uppers ends of the enclosure support members to draw the upper ends of the enclosure support members away from their natural rest state and towards the center of the mat, so that when impacted by a user against the barrier on one side of the enclosure causing the barrier and enclosure support members on that side of the enclosure to resiliently deform away from the mat, the enclosure support members and barrier on the opposite side of the enclosure will be resiliently deformed towards the center of the mat.

2. A trampoline and enclosure system according to claim 1, wherein the enclosure support members are pultruded fibreglass rods.

3. A trampoline and enclosure system comprising:

a trampoline comprising a flexible mat and a plurality of coil springs holding the mat in tension within a peripheral frame of the trampoline which surrounds the mat; and an enclosure system comprising a barrier of a flexible net material surrounding the mat above the mat and having a lower peripheral part coupled directly or indirectly to a periphery of the mat and a plurality of resiliently flexible generally upright enclosure support members outside of the barrier relative to the mat and which are connected at or towards the lower ends of the enclosure support members to the frame of the trampoline so that in their natural rest state the enclosure support members extend away from the mat, and which are connected to the barrier net only at or near an upper peripheral part of the barrier to hold the net in tension above the mat, and which enclosure support members are also connected together at or towards the upper ends of the enclosure support member to draw the upper ends of the enclosure support members away from their natural rest state and towards the center of the mat, so that when impacted by a user against the barrier on one side of the enclosure causing the barrier and enclosure support member on that side of the enclosure to resiliently deform away from the mat, the enclosure support members and barrier on the opposite side of the enclosure will be resiliently deformed towards the center of the mat.

4. A trampoline and enclosure system according to claim 3, wherein the enclosure support members are pultruded fibreglass rods.

5. A trampoline and enclosure system according to claim 1 wherein the enclosure support members are connected together at or towards their upper ends by an upper peripheral part of the barrier.

6. A trampoline and enclosure system according to claim 1 wherein the enclosure support members are connected together at or towards their upper ends by a flexible connecting element.

7. A trampoline and enclosure system according to claim 6 wherein said flexible connecting element is fixed to or integral with the barrier at or towards an upper peripheral part of the barrier.

8. A trampoline and enclosure system according to claim 1 wherein the enclosure support members are connected to the frame of the trampoline below the surface of the mat.

* * * * *